US005946732A

United States Patent [19]

Richards

[11] Patent Number: 5,946,732

[45] **Date of Patent: *Sep. 7, 1999**

[54] MOVEABLE AUXILIARY POCKET

[76] Inventor: Jeffrey Henry Richards, 1801 E. Tropicana, #9, Las Vegas, Nev. 89119

[ * ] Notice: This patent is subject to a terminal disclaimer.

[21] Appl. No.: 08/223,731

[22] Filed: Apr. 6, 1994

[51] Int. Cl.[6] ..... A41D 27/20

[52] U.S. Cl. ..... 2/247; 2/244; 2/248; 2/249; 2/251; 40/1.5; 40/1.6

[58] Field of Search ..... 2/247, 248, 249, 2/250, 251, 252, 246, 245, 244, 265; 24/459, 460, 461, 462, 3.7, 3.9, 114.05; 40/1.5 V, 1.6 V, 600, 580; 224/194, 271, 272

[56] References Cited

U.S. PATENT DOCUMENTS

| | | | |
|---|---|---|---|
| 1,658,573 | 2/1928 | Roper et al. | 40/1.5 |
| 3,438,062 | 4/1969 | Dobell | 2/247 |
| 3,611,444 | 10/1971 | Rector | 2/247 |
| 3,840,901 | 10/1974 | Eyster | 2/247 |
| 3,942,273 | 3/1976 | Adams | 40/1.5 |
| 4,236,331 | 12/1980 | Mattson | 40/1.5 |
| 4,266,300 | 5/1981 | Partridge | 2/247 |
| 4,602,390 | 7/1986 | Morera | 2/251 |
| 4,651,355 | 3/1987 | White | 2/247 |
| 4,809,894 | 3/1989 | Viio | 224/248 |
| 5,054,127 | 10/1991 | Zevchak | 2/247 |
| 5,347,733 | 9/1994 | Whittington | 40/1.5 |

*Primary Examiner*—Jeanette Chapman

[57] ABSTRACT

This invention provides a useful system for attaching and detaching an external pad to fabric. The pad serves as a base for attaching accessories like pockets, ribbons, straps, decorative patches, labels, etc. The attachment solves problems with previous portable pockets; namely, limited useful life of adhesives and having to permanently attach one member of the VELCRO pair (either hooks or loops) to the apparel and associated problems of snagging when laundering such. The solution presented provides a light weight, flexible system which is unobtrusive to the user and economical to produce.

12 Claims, 12 Drawing Sheets

MOVEABLE AUXILIARY POCKET

FIELD OF INVENTION

The present invention is directed to a temporary attachment of accessories to articles of clothing.

BACKGROUND OF THE INVENTION

The concept of having a detachable pocket for wearing apparel is shown in U.S. Pat. No. 3,611,444, incorporated herein by reference, and others. Most, however, are dependent upon some modification of the apparel. Rector, for example, uses VELCRO brand fasteners of the hooked and looped configuration which are permanently attached to various parts of the apparel so as to subsequently accept a mating part. Other detachable pockets are shown in Zerchak 1991 (U.S. Pat. No. 5,054,127) and Dobell 1969 (U.S. Pat. No. 3,438,062).

Others teach the use of an adhesive strip such as Eyster in U.S. Pat. No. 3,840,901 1974; Partridge in U.S. Pat. No. 4,266,300, 1981; and Morera et al. in U.S. Pat. No. 4,602, 390, 1986, incorporated herein by reference.

There exists a need for attaching a pocket that does not require a modification to apparel; does not depend on a particular location or particular type of material, does not degrade in time like the self-adhesive approaches nor does it present a problem in laundering like VELCRO based items or adhesive products since it is easily removed prior to laundry or dry cleaning.

Approaches to attaching objects other than pockets to articles of clothing include a wire frame as in Viio's U.S. Pat. No. 4,809,894. These and other approaches do not offer the same advantages as the present invention.

SUMMARY OF THE INVENTION

It is an object of the present invention to provide a useful system for attaching and detaching an external pad to apparel which in turn serves as a base for attaching, by various means, pockets, ribbons, straps, decorative patches, etc. Means of attachment to a garment solves major which existed problems with previous attempts to provide a truly portable pocket; namely, the problem with limited useful life of adhesives and the problem of having to permanently attach one member of the VELCRO pair (either hooks or loops) to the apparel.

Another object of the present invention is to provide an attachable and detachable pad which will accept articles with snaps or other forms of attachments such as pockets, straps and decorative patches.

A further object of the invention is to provide a pad of the kind described which has various attachment means incorporated including snaps, push pins, adhesive strips, VELCRO type hooks or loops, buttons, screw pins, bayonet twist connectors and so forth.

A still further object of the invention is to provide a means for attaching pockets such as might be used for example for glasses, keys, money, writing instruments, medical supplies and notepads. Pockets may be open, self closing, with or without flaps, zippered, ziplocked, or other self-evident means.

Yet another object of the invention is to provide a lightweight and flexible system which is unobtrusive to the user.

These and other objects of the present invention will become more readily appreciated and understood from a consideration of the following detailed description of the preferred embodiments when taken together with the accompanying drawings.

The present invention is adaptable to accept a multitude of styles, shapes and materials in the form of pockets, straps, envelopes, design accents, among others. Thus it can be modified when changing from one outfit to another, from one uniform to another.

A particular advantage is use of the present invention with sweaters and sporting apparel without inducing any permanent changes in the material. It can be both stylish and functional.

DETAILED DESCRIPTION OF THE PREFERRED EMBODIMENT

Figure 1:
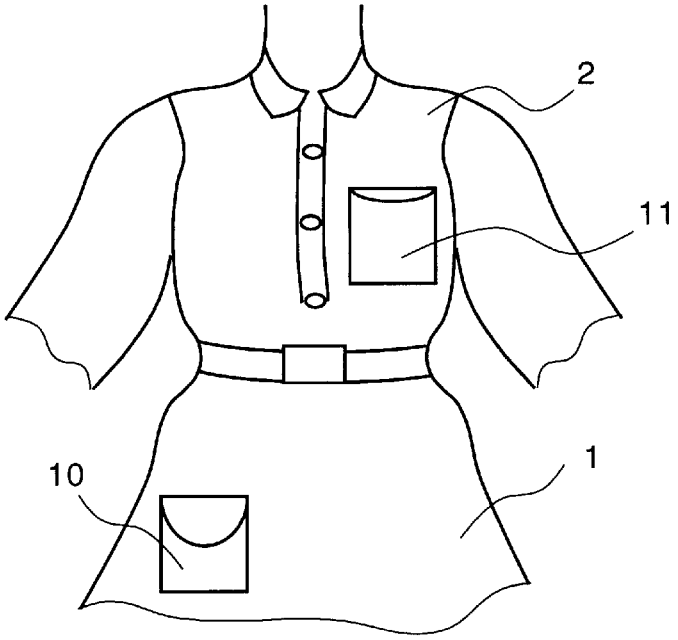
FIG. 1 depicts detachable pockets being worn on a vest or sweater and a skirt. The outer pocket hides the base plate.

The present invention is directed to a device which facilitates temporary attachment of items such as a pocket, glasses case, or display holder to wearing apparel. As shown in FIG. 1, a preferred embodiment of the present invention is directed to a pocket device 10 or glasses case 11 which is attached to garment 1 and garment 2, respectively. The garment may be shirt, vest, jacket, pants, sweater or any other textile-type product whether worn or not. The outer pockets 10, 11 hide the underlying base plates and attachment mechanisms.

Figure 2A:
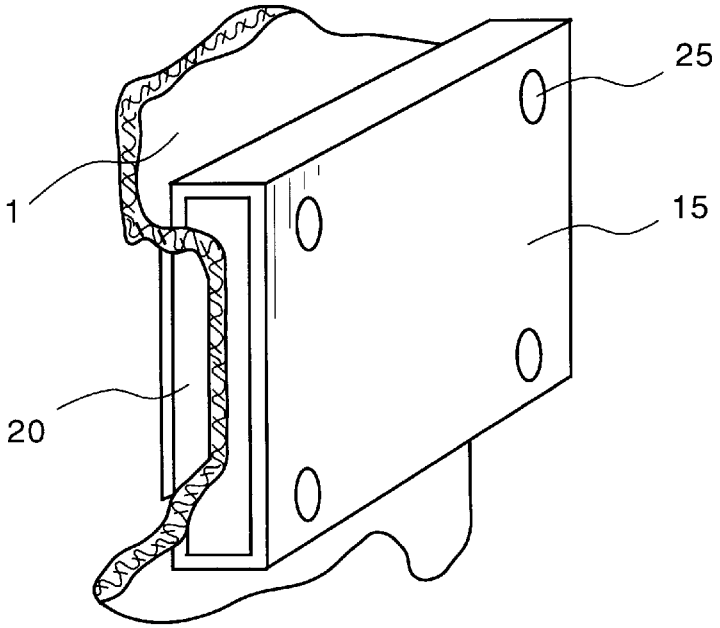
FIG. 2*a*–2*d* depict one mode of attachment of the base plate to the garment using a snugly fitting piece placed behind the garment and pressed into the base plate.

FIG. 2*a*–2*d* depict one mode of attachment of the base plate 15 to the garment 1 using a snugly fitting piece (back plate 20) placed behind the garment and pressed into the back side of the base plate 15. FIG. 2*a* presents a front perspective view of the base plate 15 showing the face of the fabric 1 and four snap fittings 25 which secure the frontal accessory which is the pocket, decorative piece, holding straps or other accessory.

Figure 2B:
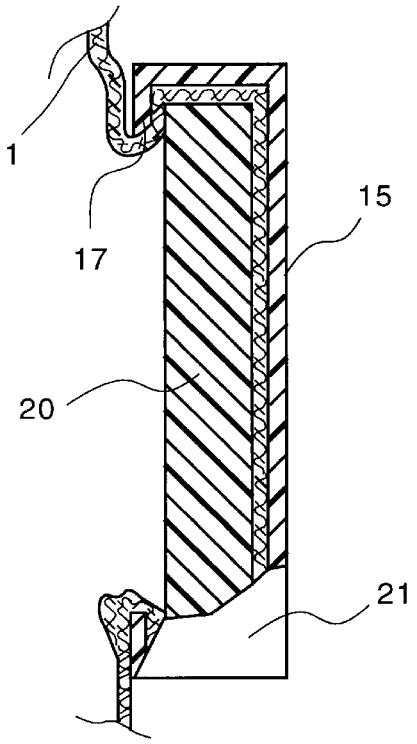

FIG. 2*b* is a side view of the system within the side wall 21 cut away to show the base plate 15, the back plate 20 and the intervening fabric 1 all held by the tabs 17.

Figure 2C:
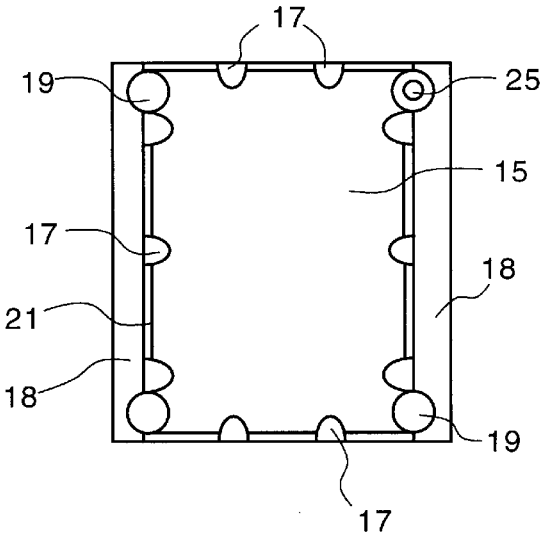

FIG. 2*c* shows the back of the base plate 15 along with side walls 21, retaining tabs 17, side wings 18 to support larger items (pockets etc.) and the four openings 19 to accept one mating half of the snaps 25, pins, screw fittings or other attachment devices. Side walls 21 are slightly flexible to allow the material and back plate to push it outwards as forced past the tabs and then return to resting position once back plate 15 passes by, thereby forming a catch.

Figure 2D:
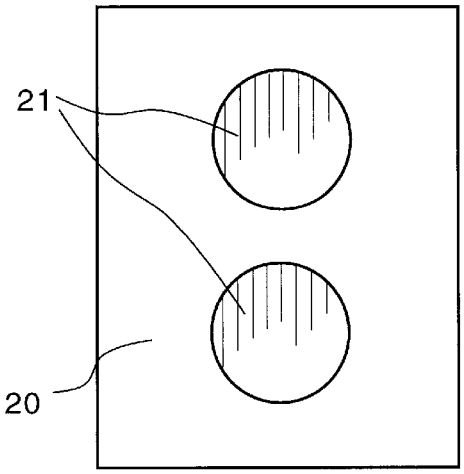

FIG. 2*d* is the back view of back plate 20 showing the openings 19 which in this instance provide a means to grip the back plate 20 when pressing material 1 into in the base plate or when releasing the material 1. While circular holes are shown, they could be square, rectangular, oblong or any other shape and size which allowed fingers to grasp it. Other grasping aids as tabs (collapsible or fixed) or tapes are suitable adaptations. The back plate 20 is of such a thickness that it plus the material 1 will fit within the enclosure depicted in FIG. 2*c* formed by the back of the base plate, the sides of the base plate 21 and the tabs 17.

Figure 3A:
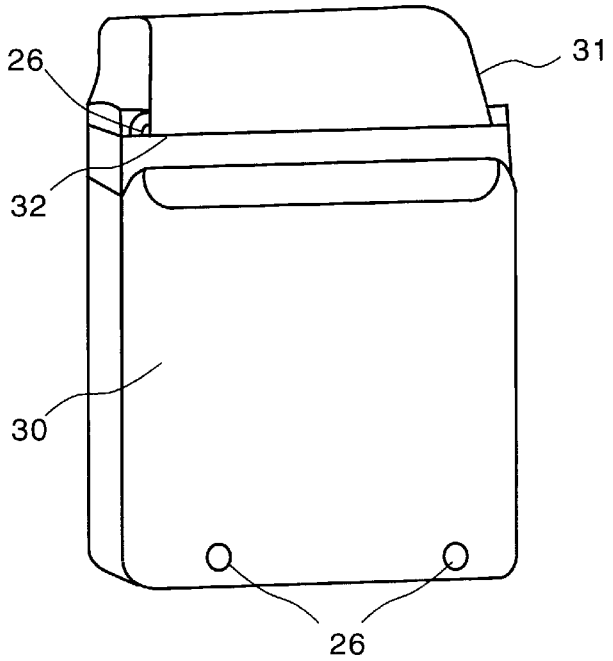
FIG. 3*a*–3*b* depict one mode of attachment (snaps) of the front piece (glasses case with security flap in this instance) to the base plate.
Figure 3B:
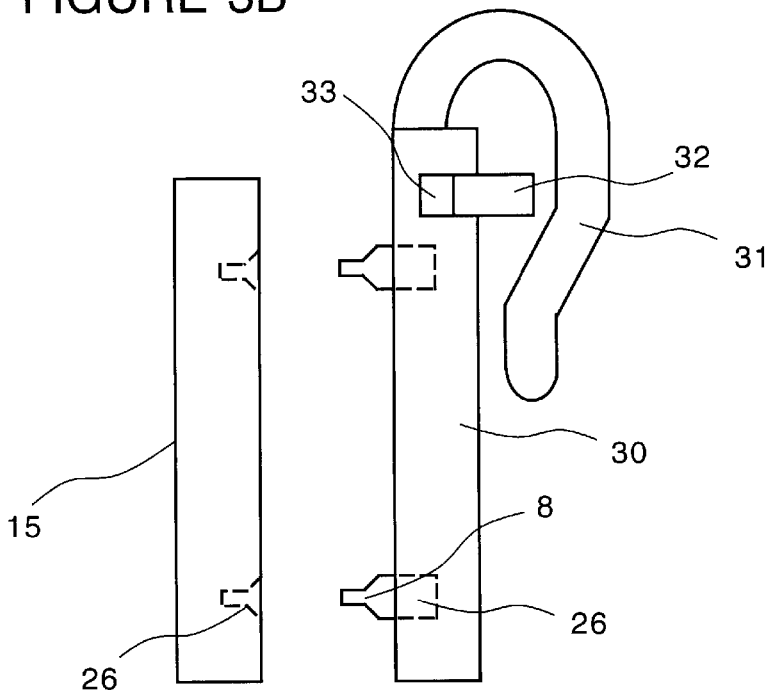

FIG. 3*a*–3*b* depict one mode of attachment of the frontal piece to a base plate. FIG. 3*a* gives the front perspective view.The tops of three of the four snaps 26 are seen on frontal accessory 30. The frontal accessory is in this case, a glasses case 30 with security flap 31 and flap hold down band 32. The flap hold down band 32 may be attached to the case in various ways including sewing, cement or rivets.

FIG. 3*b* gives the side view and includes the base plate 15. On the base plate 15 is the mating snap 25 (in this instance the female part) to the snap part 26 (male part) on the case 30. Case 30 is comprised of two pieces of material sewn together at the sides to form a pocket plus a strap 32 near the top to secure the flap 31. The strap 32, shown in its inactive mode, is attached at each end 33, for example by sewing, rivets or gluing.

Figure 4A:
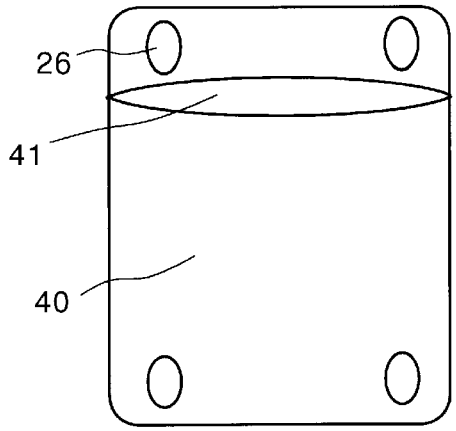
FIG. 4*a*–4*f* depict other designs of front pieces including open case (as for pencils, pads); a draw-string bag (as for money); and a front opening (as for keys) , a series of rings for attaching articles, a decorative piece and a message identification or display piece.

FIG. 4*a*–4*f* depicts other forms of frontal pieces. FIG. 4*a* shows an open case 40 (as for pencils, pads). Typically such a case 40 is made of two sheets of plastic which are heat fused around the edges. There is an opening 41 across the top. Points of attachment 26 to the base plate are indicated.

Figure 4B:
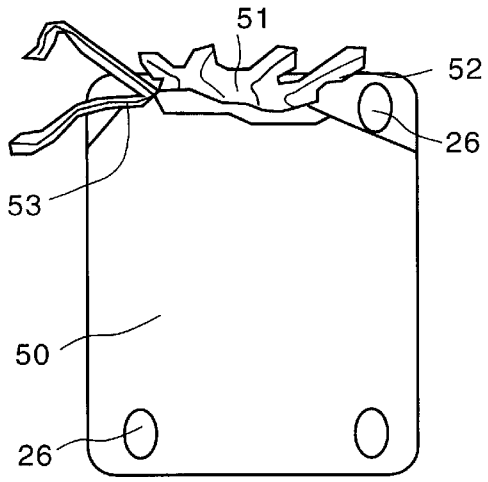

FIG. 4*b* shows a draw-string bag 50 (as for money) comprised of a top opening 51 folded over (to form a casing) portion 52 which forms a loop around the top through which draw strings 53 are run. Three snap parts 26 are also seen.

Figure 4C:
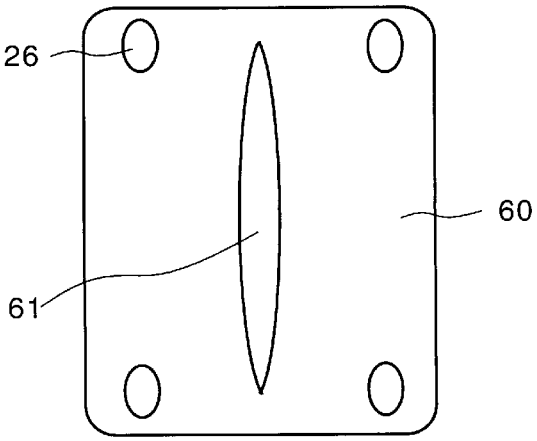

FIG. 4*c* depicts a front opening accessory 60 similar to a small coin purse (as for coins or keys). The lips 61 of the enclosure may be of elastic material so that they remain closed unless compressed as from the ends. This frontal accessory piece is similarly attached to the underlying base plate by one or more snaps, pins, or rivets 26.

Figure 4D:
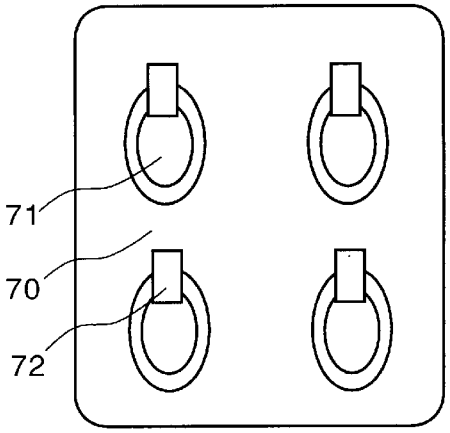

FIG. 4*d* depicts a frontal accessory having one or more rings 71 and mounting loops 72 for the rings 71. These rings may be used decoratively or for attachment of articles associated with work, display, hobbies, recreation and the like.

Figure 4E:
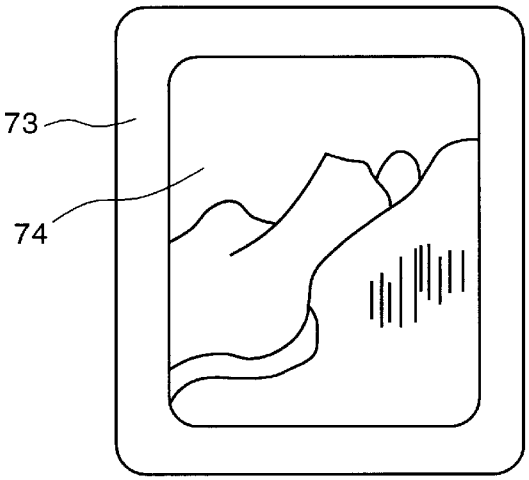

FIG. 4*e* depicts a decorative piece consisting of a front panel 73 and a decorative insert 74. One application for such a device in on suspended material, such as wall hangings, curtains, and cloth partitions (as in display areas). Another application is to wear as an accessory, much like accent jewelry might be worn.

Figure 4F:
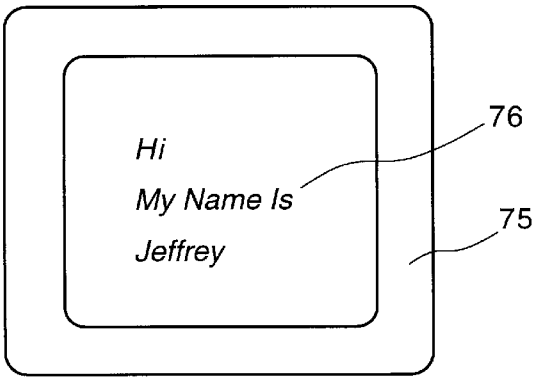

FIG. 4*f* depicts an information display panel 75 with a portion 76 for a message, identification or display piece. One application for such a device is on manikins in stores to identify , for example, price, features, and brand of displayed apparel.

Figure 5A:
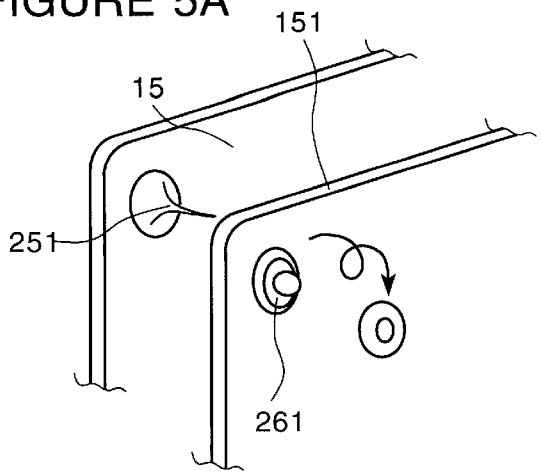
FIG. 5*a*–5*e* depict alternate means for attachment of front piece to base plate.

FIG. 5*a*–5*e* depict alternate means for attachment of front piece 151 to base plate 15. FIG. 5*a* shows use of a mechanism similar to that found on some tie tacks. It consists of a pin part 251 and head secured to the base plate and a clasping part 261 secured to the facing attachment (pocket etc.). The clasping part is, in this instance, a two or more component device with an internal concentrically applied tensioning mechanism. It is understood that the male and female parts can be reversed.

Figure 5B:
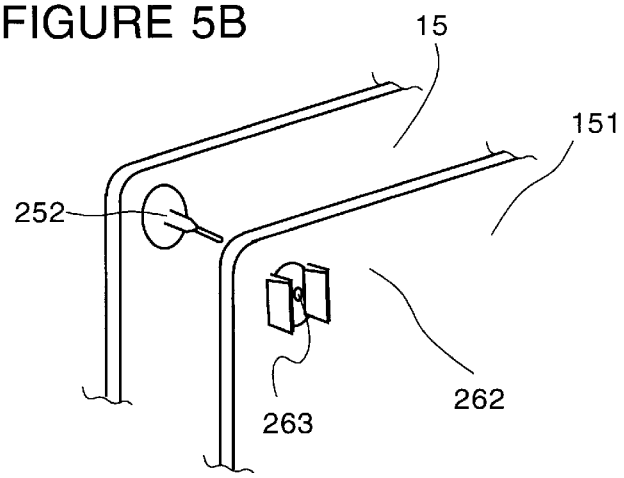

FIG. 5*b* depicts a pin mechanism similar to that found on many lapel pins. It consists of a male pin 252, in some instances with transverse scoring, with head secured to the base plate 15 and a female part 262 comprised of an externally applied tension clips 263 connected to a base which is secured to the facing attachment 151. The facing attachment 151 is released by squeezing the ends of the clips 263 which are arranged in such a way as to grasp the center pin 252 at rest and pull back from the center pin 252 when pressed. Use of an attachment method common for earrings for pierced ears is another adaptation.

Figure 5C:
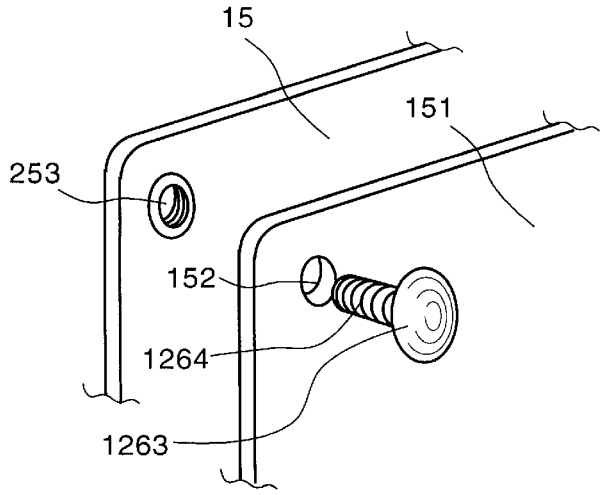

FIG. 5*c* depicts a screw pin mechanism similar to that found on some lapel pins and earrings. In this instance it consists of an internally threaded button 253 secured to a base plate 15 and large headed pin 1263 having a threaded shaft 1264 which is inserted through opening 152 in the facing attachment 151 to engage the threads in button 253 of base plate 15. The head of the pin 1263 may be slotted, enlarged or made in a shape easier to grip with the fingers for turning.

Figure 5D:
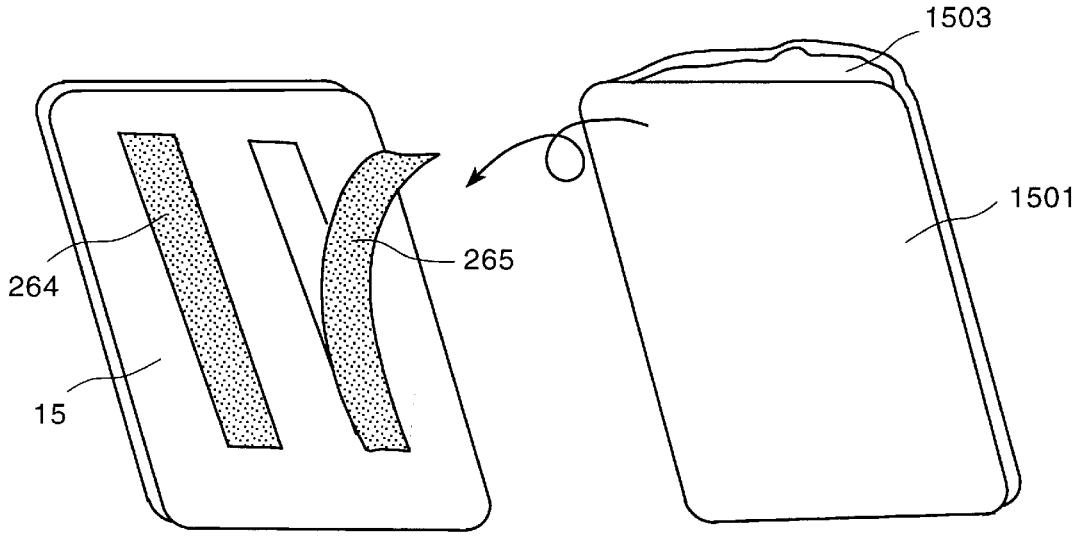

FIG. 5*d* depicts an attachment method using adhesive strips. The adhesive strips 264 and their temporary protective covers 265 may be placed either on the base plate 15, the facing attachment 1501, or on both. Pocket opening 1503 is indicated in the back view of the frontal accessory 1501. The size and placement of adhesive strips and the tackiness of adhesive compound on the strips can be adjusted over a broad range of strength and re-use requirements.

Figure 5E:
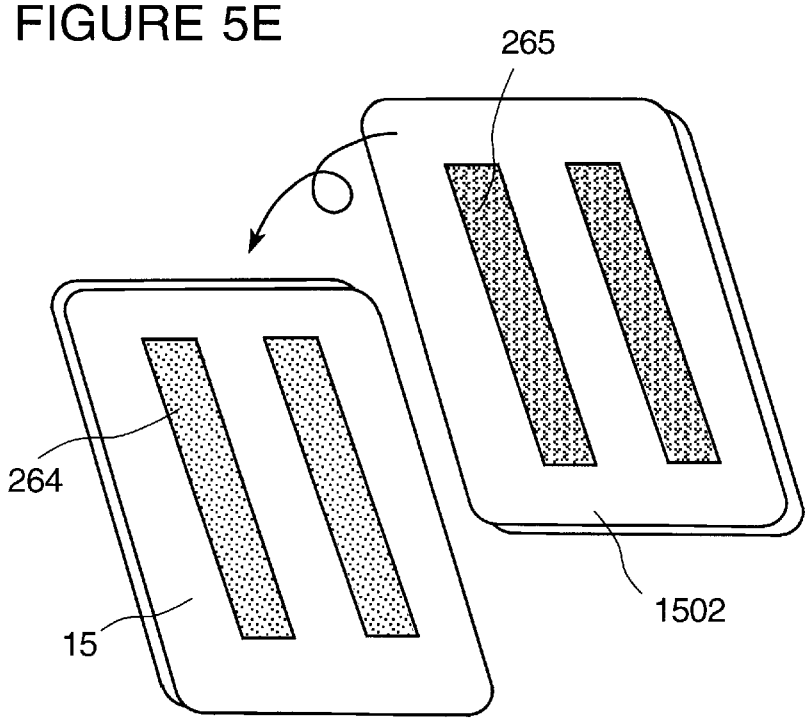

FIG. 5*e* depicts an attachment method using hook and loop strips as is available under the trademark VELCRO. One or more strips or patches of loop material 255 are secured (by adhesive or mechanical means) to the base plate 15 so as to be aligned with strips or patches of hook material 265 on the facing attachment 1502. The strips of hooks 265 and loops 255 can be attached on the opposite surfaces as well.

Figure 6A:
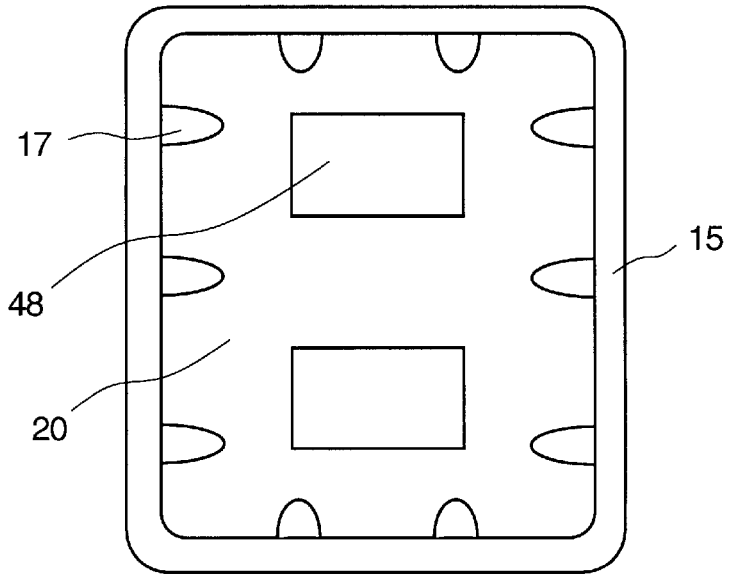
FIG. 6*a*–6*e* depict alternate means for attachment of base plate to garment.

FIG. 6*a*–6*d* depict alternate means for attachment of a base plate to garment. In FIG. 6*a* a back plate 20 presses the material into the enclosing base plate 15 past the gripping tabs 17. The back plate 20 may be rigid as from metal, acrylic or polymers having similar mechanical properties or somewhat pliable as from hard rubber. The latter provides positive holding power over a greater range of material thicknesses. The ability to adjust to a range of dimensions, i.e. of material in a garment is dimensional adjustment. The size and shape of gripping holes 21 (as in FIG. 2*d*) will influence mechanical properties of the back plate.

Figure 6B:
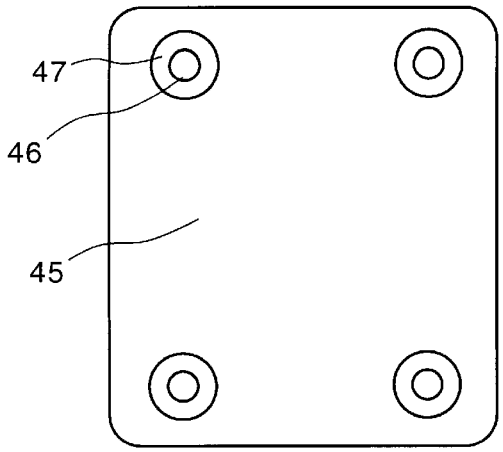

FIG. 6*b* depicts a dispersed traction fit in which pegs 46 from one member (such as the base plate, not shown) force material into openings 47 on the second member 45 (the back plate in this instance).

Figure 6C:
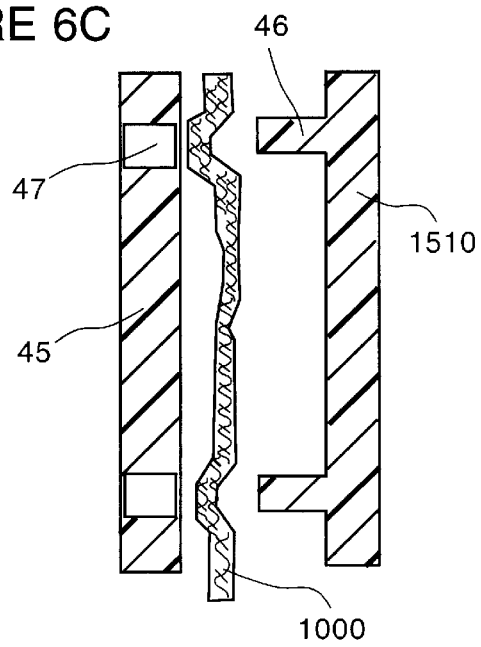

FIG. 6*c* shows the mechanism of FIG. 6*b*, inside view. The base plate 1510 has at least one (in this instance four) pegs 46 which force material 1 into restricted diameter openings 47 in the back plate 45.

Figure 6D:
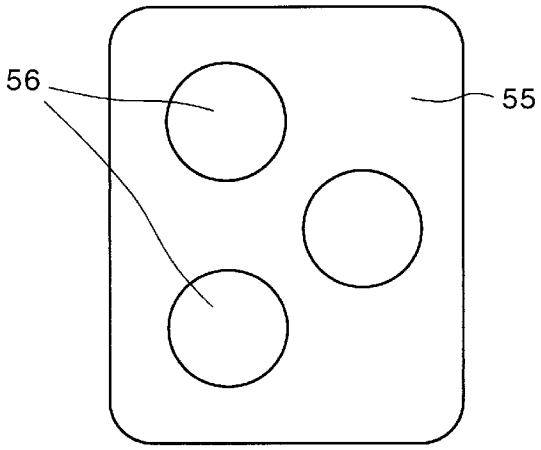

FIG. 6*d* depicts a back plate 55 in which one or more magnets 56 are placed which engage a ferrometalic base plate (not shown but similar to base plate 15 as in FIG. 6*a*) with intervening fabric. Magnets may be discrete as shown or be a continuous sheet depending on strength and cost effectiveness.

Figure 6E:
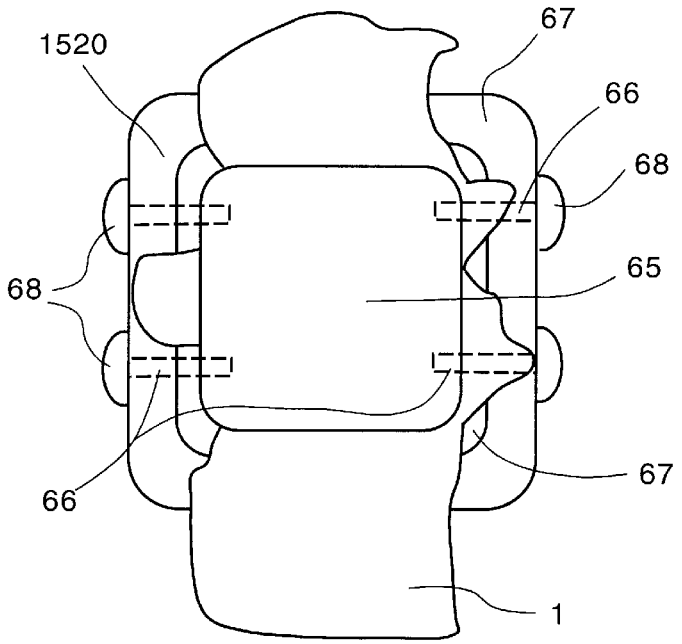

FIG. 6*e* depicts yet another holding mechanism. This side pin mechanism consists of a rigid to semi-rigid back plate 65 with pre-drilled holes 66 on at least two edges. The back plate 65 pushes fabric 1 into a hollowed out section 67 of the base plate 1520 and then is secured by pushing pins 68 through the edges of the base plate 1520 through fabric 1 and into the holes 66 of the back plate 65. Heads of pins 68 may be enlarged to provide ease in gripping by fingers.

Figure 7A:
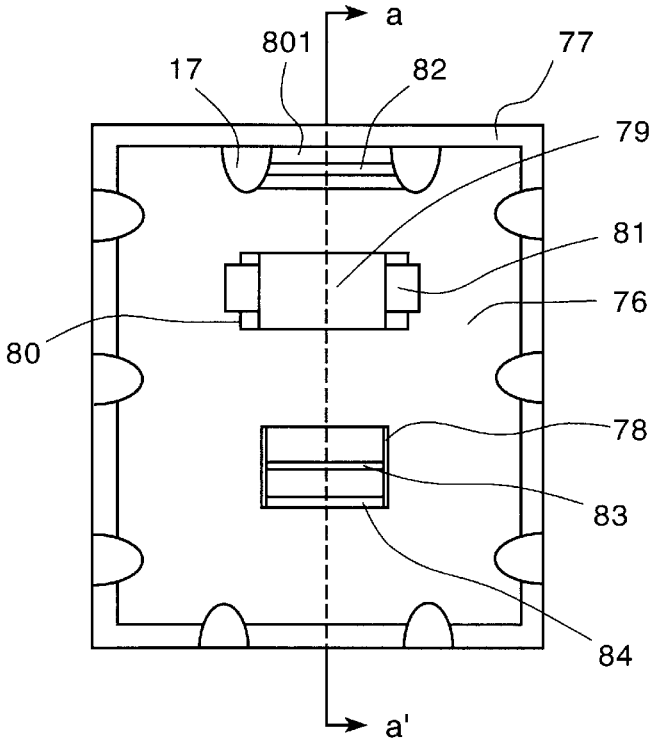
FIG. 7*a*–7*e* depict a positive action means for attachment of base plate to garment in different views.

FIG. 7*a*–7*f* depict a positive action slide bar means for attachment of base plate 77 to garment in different views. In FIG. 7*a* the back view of a slide bar mechanism is seen along with back plate 76 and base plate 77 without the garment intervening. The slide bar mechanism is comprised of a rigid back plate 76 which has two openings: one 78 for moving the slide 79 and the other 80 for securing the slide with tabs 81. Also seen is the locking end 82 of the slide mechanism which engages the tabs 17 of base plate 77. In window 78, it is seen that slide 79 has two raised features. The larger (upper in this view) raised portion 83 provides a point of contact to move the slide 79 with one's finger to engage the tabs 17 and secure the fabric. The lower raised portion 84 provides a stop at the end of the slide 79. In addition to the two windows 78, 80 of the back plate 76 there is a notch 801 at the end to provide inset for the engaging flange 82 of the slide 79.

Figure 7B:
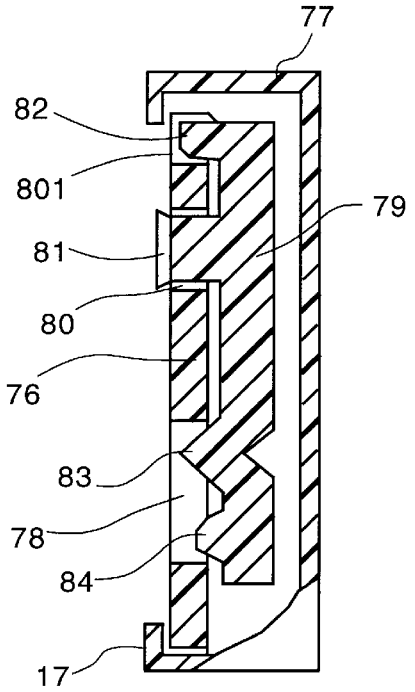

FIG. 7*b* shows a cross sectional view taken along line a–a' of FIG. 7*a*. Seen is back plate 76 with windows openings 78,80 and notch 801 and a cut away view of front plate 77. Also seen is slide bar 79 as it extends from lower window 78 to its extended position when endpiece 82 engages tabs (see tabs 17 in FIG. 7A). Note that raised portions 83 and 84 are flush with or below the plane of the back surface of the back plate 76 and that tabs 81 extend beyond the plane of the back surface of back plate 76.

Figure 7C:
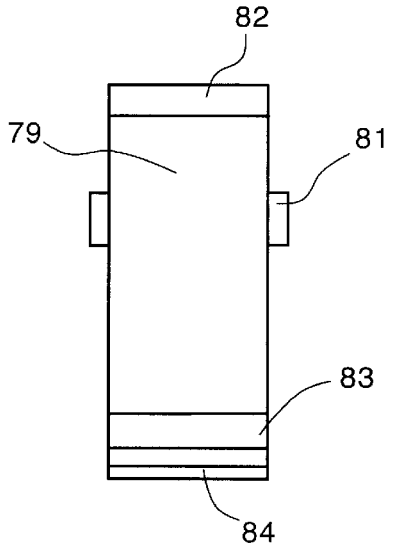
Figure 7D:
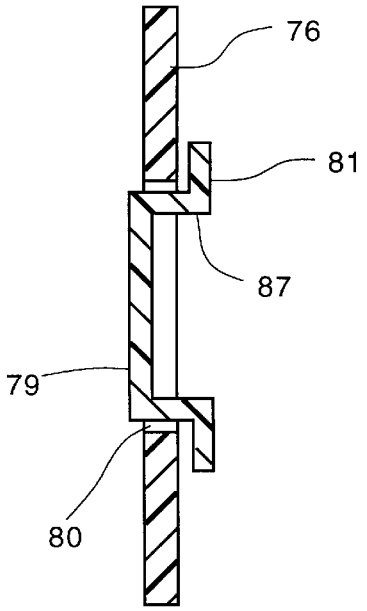

FIG. 7*c* shows a view of the underlying slide/lock mechanism 79 as it would appear if the back plate of FIG. 7*a* was removed. The locking slide is comprised of two retaining tabs 81 which fit through the back plate upper window 80, an end piece 82 which slides under the end tabs 17 of front plate enclosure 77 shown FIG. 7*a*. Further enhancements include a stop ridge 83 to indicate when lock is fully engaged and a raised portion 84 to provide greater ease in engaging or disengaging the mechanism with one's fingers.

FIG.,7d shows a cross section of slide/lock mechanism 79 when in the window 80 of the back plate 76. Tabs 81 are seen to be formed of a perpendicular section 87 so that a second bend provides a lap over the edges of the window 80.

Figure 7E:
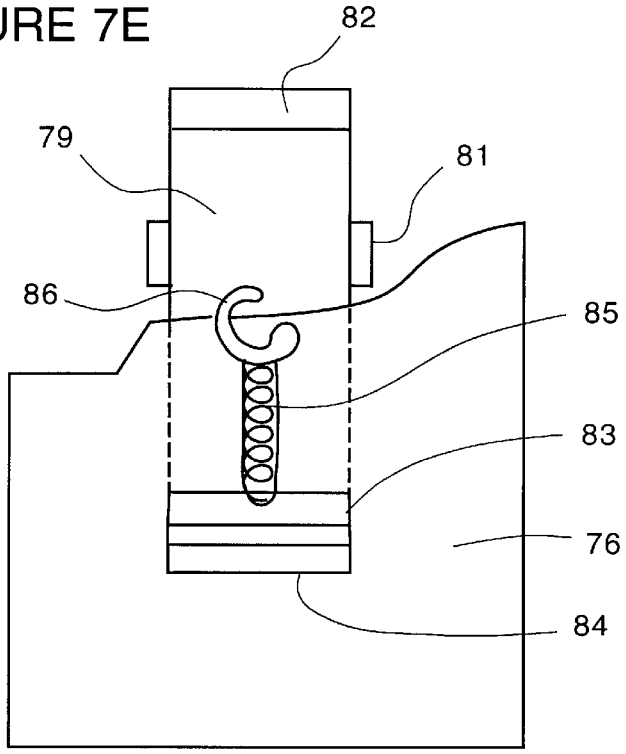

FIG. 7*e* shows cut away and selectively transparent view through a back plate of an optional enhancement of slide 79 in which a spring 85 has a point of attachment 86 to backplate 76 at one end and to lip 83 of the slide 79 so that the lock remains engaged (most extended position) excepted when forced to open.

Figure 8:
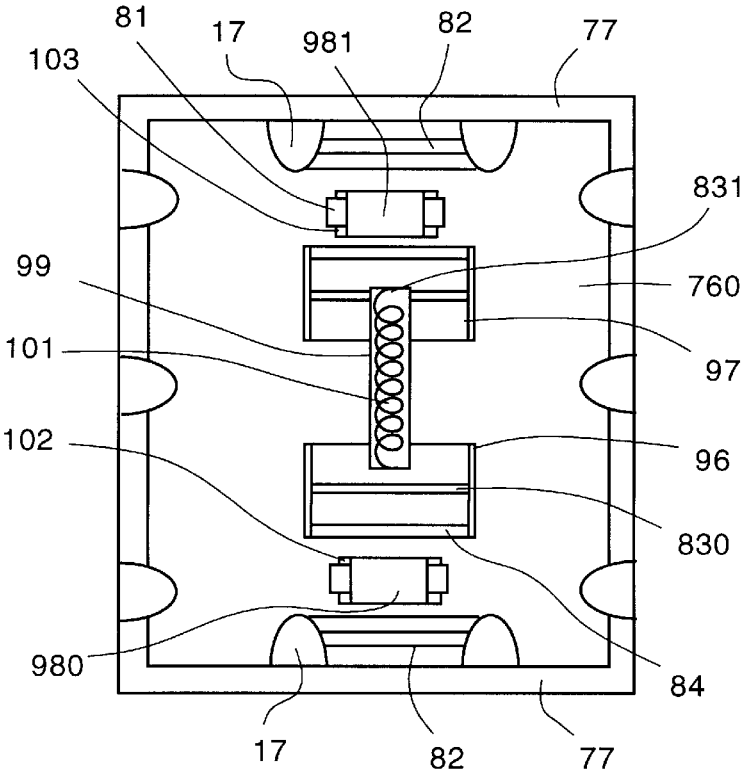
FIG. 8 depicts a double action positive action means for attachment of base plate to garment.

FIG. 8 is the back view of a double acting positive action means for attachment of base plate 77 to garment. This double action mechanism 95 is comprised of two large windows 96, 97 and two oppositely positioned slides 980, 981 which mechanically engage end tabs 17 of front plate 77. A compression spring 101 which runs though a center line longitudinal hole 99 in the back plate 760 provides outwardly directed force to keep locking edges fully engaged except when manually squeezed together by pressing lips 830, 831 inward.

The sliding lock mechanism provides a means for dimensional adjustment.

Apropriate selection of materials for the components in the various forms described is an important part of the functionality of the invention. For the back plate, especially with overhanging tabs, it is important to have a balance between rigidity, ruggedness, flexibility and moldability. Our experience has been that a number of different thermoplastics, thermosetting plastics, rubbers and coated metals meet these requirements. However, among these, the thermoplastics, such as ABS, nylon, polyethylene, and polystyrene are preferred.

Accordingly, the present invention has been described with some degree of particularity directed to preferred embodiments of the present invention. It should be appreciated, though, that the present invention is defined by the following claims construed in light of the prior art so that modifications or changes may be made to preferred embodiments of the present invention without departing from inventive concepts contained herein.

I claim:

1. A removable accessory for attaching to fabric comprising:

a flat back plate for placement on one side of said fabric;

a separate base plate for placement on the other side of said fabric, said base Plate securable by interaction with said back plate at more than one point on such that said base plate resists rotational movement;

a frontal piece and means for attaching said frontal piece to said base plate.

2. The accessory of claim 1 wherein said attaching means is detachable.

3. The accessory of claim 1 wherein said back plate comprises a male part and said base plate comprises a female part.

4. The accessory of claim 1 wherein said base plate comprises a male part, and said back plate comprises a female part.

5. The accessory of claim 1 wherein said base plate further comprises attachment means chosen from the group consisting of threaded and unthreaded pins, snaps, friction catches and magnets.

6. The accessory of claim 3 wherein said female part is formed from material chosen from the group consisting of metal, rubber, and plastic.

7. The accessory of claim 1 wherein said flat back plate further comprises means for dimensional adjustment, such that different thicknesses of fabric may be accommodated.

8. The accessory of claim 7 wherein said dimensional adjustment means further comprises an elastic material.

9. The accessory of claim 7 wherein said dimensional adjustment means further comprises a sliding lock mechanism.

10. The accessory of claim 9 wherein said dimensional adjustment means further comprises a spring for holding said locking mechanism in an extended state.

11. The accessory of claim 1 wherein said frontal accessory comprises a self-contained pocket.

12. The accessory of claim 11 wherein said self-contained pocket comprises mechanical means to attach to a base plate.

* * * * *